US008841857B2

(12) United States Patent
Chu et al.

(10) Patent No.: US 8,841,857 B2
(45) Date of Patent: Sep. 23, 2014

(54) DRIVING CIRCUIT

(71) Applicant: Raydium Semiconductor Corporation, Hsinchu (TW)

(72) Inventors: Chih-Wei Chu, New Taipei (TW); Yung-Hsiang Yang, Hsinchu (TW); Shu-Kuang Chou, New Taipei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 116 days.

(21) Appl. No.: 13/716,401

(22) Filed: Dec. 17, 2012

(65) Prior Publication Data

US 2013/0278143 A1 Oct. 24, 2013

(30) Foreign Application Priority Data

Apr. 20, 2012 (TW) ..... 101114240

(51) Int. Cl.
*H05B 37/02* (2006.01)
*F21V 29/00* (2006.01)
*H05B 33/08* (2006.01)

(52) U.S. Cl.
CPC ..... *H05B 37/02* (2013.01); *F21V 29/26* (2013.01); *H05B 33/083* (2013.01)
USPC ..... 315/291; 315/294; 315/312; 315/320; 315/169.1; 315/185 R; 345/76; 345/77; 345/204; 345/690

(58) Field of Classification Search
CPC .... H05B 37/02; H05B 37/029; H05B 33/083; H05B 33/0803; H05B 33/0815; H05B 33/0833; G09G 3/22; G09G 2320/0626; Y02B 20/342; Y02B 20/346; F21V 29/26
USPC ..... 315/169.1–169.3, 185 R, 291, 294, 312, 315/320, 302, 323; 345/76, 77, 82, 204, 345/212, 690
See application file for complete search history.

(56) References Cited

U.S. PATENT DOCUMENTS 7,081,722 B1 * 7/2006 Huynh et al. ..... 315/323
7,482,759 B2 * 1/2009 Yoneyama et al. ..... 315/169.1
7,755,580 B2 * 7/2010 Mas et al. ..... 345/82

* cited by examiner

*Primary Examiner* — Haiss Philogene

(57) ABSTRACT

A driving circuit includes a plurality of light-emitting units, a plurality of switches, and a bias current module, wherein the light-emitting units are coupled with each other in series and are driven with an input voltage varying according to a frequency. Each switch has a reference voltage and a critical activation voltage and includes a light-emitting end and a bias end opposite to the light-emitting end, wherein the light-emitting end is coupled with the light-emitting units, and the bias ends of the switches are coupled with each other. The bias current module is coupled with the bias ends of the switches and has an operating bias voltage varying according to the frequency, wherein each switch is driven to be activated or to be deactivated according to a relation of the critical activation voltage and a difference between the reference voltage and the operating bias voltage.

10 Claims, 8 Drawing Sheets

DRIVING CIRCUIT

BACKGROUND OF THE INVENTION

1. Field of the Invention

The present invention relates generally to a driving circuit; particularly, the present invention relates to a light-emitting diode (LED) driving circuit capable of decreasing the cost and enhancing efficiency.

2. Description of the Prior Art

In general, the conventional light-emitting diode (LED) driving circuit utilizes AC/DC power convertor to generate an input voltage, and the input voltage drives LEDs to generate light. In practical applications, the LED driving circuit includes a power supply module, wherein the power supply module controls current of the circuit, so that current amplitude crossing over the LEDs remains constant, and the brightness of the LEDs maintains constant.

Particularly, the conventional LED driving circuit further includes a plurality of switches and a plurality of comparators corresponding to the switches, wherein the switches are respectively coupled with corresponding comparators and LEDs. In addition, each comparator has a constant voltage and determines whether to transmit activating control signal to the switches according to the relation between the constant voltage and the input voltage. In practical applications, the conventional LED driving circuit controls the light-emitting result of driving the LEDs according to the activating condition of the switches. In other words, if more switches are driven to be activated, more LEDs generate light. However, in the circuit, because each switch has the comparator corresponding to the switch, the circuit requires lots of comparators, resulting in a complicated driving circuit and the increase in production cost.

In addition, please refer to FIG. 1; FIG. 1 is a schematic view showing the relation between the input current of the conventional LED and the current of the LED. As shown in FIG. 1, an input current curve 11 has full-wave rectification waveform, and an LED current curve 12 has sawtooth waveform. In other words, when the input voltage drives the LEDs to generate light, the LEDs waste some of input current, resulting in waste of power and reduction of cooling efficiency.

For the above reasons, it is an object how to design an LED driving circuit for enhancing efficiency and decreasing the cost.

SUMMARY OF THE INVENTION

In view of prior art, the present invention provides a driving circuit having high operating efficiency and simplified structure.

It is an object of the present invention to provide a driving circuit having different switch structure to decrease the cost.

It is an object of the present invention to provide a driving circuit utilizing a bias current module to enhance efficiency.

It is an object of the present invention to provide a driving circuit coupled with a heat sink module to offer the heat dissipation function.

Embodiments of the present invention provides a driving circuit including a plurality of light-emitting units, a plurality of switches, and a bias current module, wherein the light-emitting units are coupled with each other in series and are driven with an input voltage varying according to a frequency. Each switch has a reference voltage and a critical activation voltage and includes a light-emitting end and a bias end opposite to the light-emitting end, wherein the light-emitting end is coupled with the light-emitting units, and the bias ends of the switches are coupled with each other. The bias current module is coupled with the bias ends of the switches and has an operating bias voltage varying according to the frequency, wherein each switch is driven to be activated or to be deactivated according to a relation of the critical activation voltage and a difference between the reference voltage and the operating bias voltage.

It is noted that the switches include a plurality of operating switches and a terminal switch. The light-emitting ends of the operating switches are respectively coupled with a plurality of coupling nodes of the light-emitting units. The light-emitting end of the terminal switch is coupled with a terminal end of the light-emitting units, and the reference voltage of the terminal switch is larger than the reference voltage of any one of the operating switches. A corresponding one of the switches is driven to be activated when the reference voltage thereof is larger than the operating bias voltage and the difference between the reference voltage thereof and the operating bias voltage is equal to or larger than the critical activation voltage thereof.

Compared to prior arts, the driving circuit of the present invention utilizes the switches having the reference voltage and the critical activation voltage and also changes the connecting relation between the switches and the light-emitting units, further simplifying the configuration of the driving circuit. In practical applications, no matter how many light-emitting units are driven to be activated, any one of the switches needs to be activated without driving all of the switches to be activated. In addition, the voltage and the input voltage utilized by the light-emitting units are full-wave rectification voltages, so that less input voltage is wasted, further enhancing the efficiency.

The detailed descriptions and the drawings thereof below provide further understanding about the advantage and the spirit of the present invention.

DETAILED DESCRIPTION OF THE PREFERRED EMBODIMENT

According to an embodiment of the present invention, a driving circuit is provided in a simplified structure. In the embodiment, the driving circuit can be an LED driving circuit. Particularly, the driving circuit changes the connecting relation between the LEDs and other components to simplify the structure.

Figure 1:
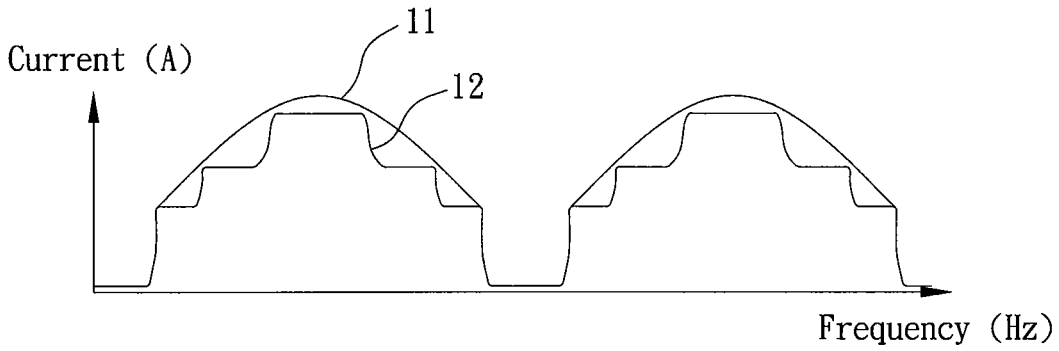
FIG. 1 (PRIOR ART)
FIG. 1 is a schematic view showing the relation between the input current of the conventional LED and the current of the LED.
Figure 2:
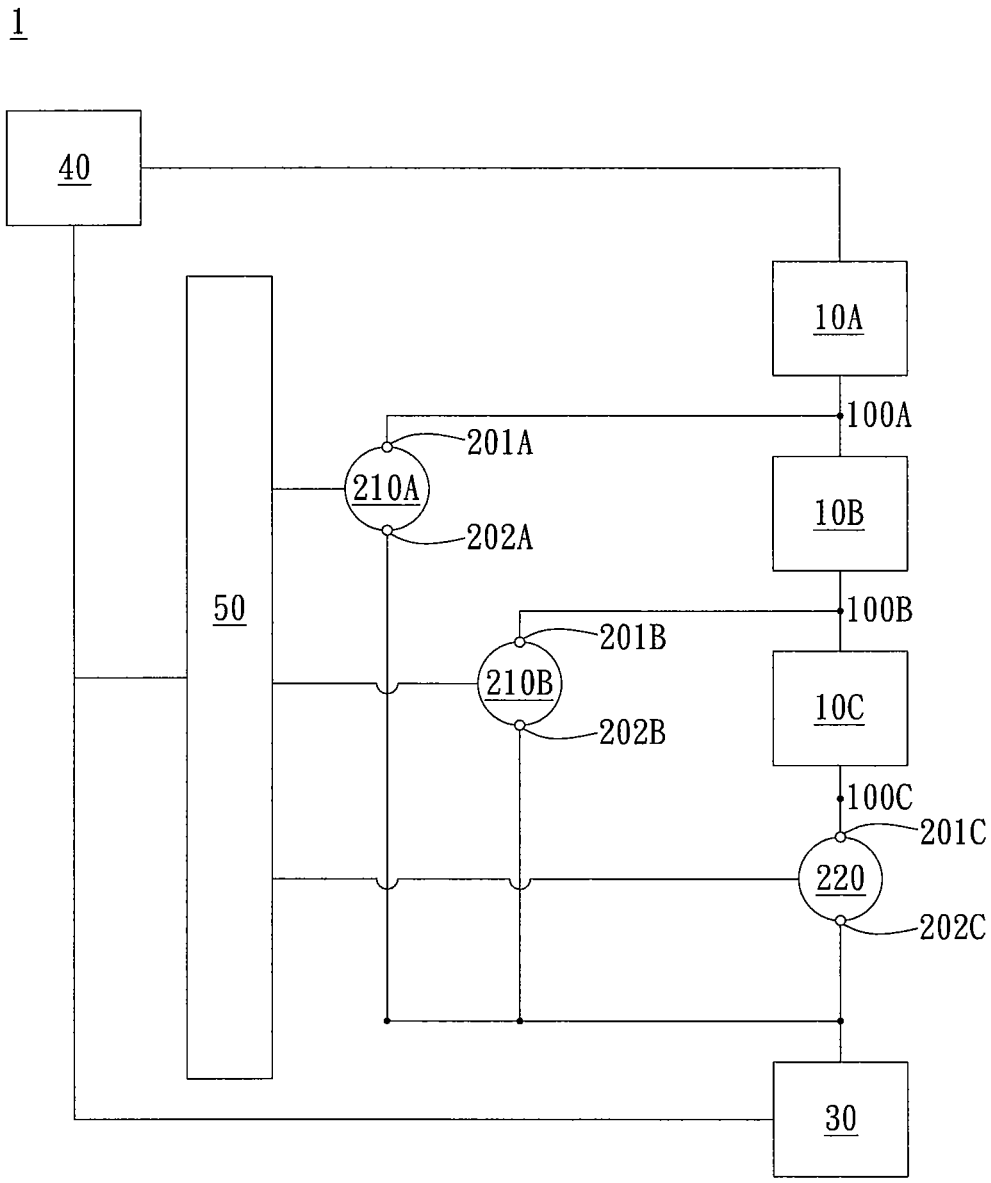
FIG. 2 is a schematic view of the embodiment of the driving circuit of the present invention.

Please refer to FIG. 2; FIG. 2 is a schematic view of the embodiment of the driving circuit of the present invention. As shown in FIG. 2, the driving circuit 1 includes a plurality of light-emitting units 10A~10C, a plurality of switches, a bias current module 30, a power supply rectifier 40, and a voltage generating module 50, wherein the switches include a plurality of operating switches 210A/210B and a terminal switch 220. It is noted that the light-emitting units 10A~10C are coupled between the power supply rectifier 40 and the bias current module 30; the operating switches 210A/210B and the terminal switch 220 are coupled between the light-emitting units 10A~10C and the voltage generating module 50; the operating switches 210A/210B and the terminal switch 220 are coupled with the bias current module 30.

In practical applications, the power supply rectifier 40 is coupled with the light-emitting units 10A~10C and provides an input voltage. Actually, the power supply rectifier 40 has an alternating current (AC) power and a rectifier module, wherein the rectifier module converts voltage of the AC power into direct current (DC) voltage. For instance, the power supply rectifier 40 can be a half-wave power supply rectifier or a full-wave power supply rectifier, wherein the full-wave power supply rectifier includes a bridge full-wave power supply rectifier, a center-tapped power supply rectifier, a vacuum tube power supply rectifier, a three-phase power supply rectifier, etc., but not limited to the embodiment. In the embodiment, the power supply rectifier 40 converts AC voltage into a rectified input voltage, wherein the input voltage is a full-wave rectification voltage.

In the embodiment, the light-emitting units 10A~10C are coupled with each other in series and are driven with the input voltage varying according to a frequency. It is noted that in other embodiments, the driving circuit 1 can be disposed with different amounts of light-emitting units according to practical requirements, not limited to the embodiment. In addition, the light-emitting unit of the present invention can be LED, laser light-emitting unit, fluorescence device, or the combinations thereof. In the embodiment, the light-emitting unit is the LED, wherein colors of the LED include white, red, green, and/or blue.

It is noted that, when the light-emitting units 10A~10C are driven with the input voltage which varies according to the frequency and is a full-wave rectification voltage, a voltage crossing over the light-emitting units is a full-wave rectification voltage. In addition, the frequency can be 60 Hz, 120 Hz, 50 Hz, or 100 Hz, but is not limited to the embodiment. In the embodiment, the frequency is preferably 120 Hz.

As shown in FIG. 2, each switch has a reference voltage and a critical activation voltage and includes a light-emitting end 201A/201B/201C and a bias end 202A/202B/202C opposite to the light-emitting end 201A/201B/201C, respectively. In addition, the light-emitting ends 201A~201C are respectively coupled with the light-emitting units 10A~10C, and the bias ends 202A/202B/202C of the switches 210A/210B/220 are coupled with each other. For instance, the light-emitting end 201A of the operating switch 210A is coupled with a coupling node 100A of the light-emitting units 10A/10B. The light-emitting end 201B of the operating switch 210B is coupled with a coupling node 100B of the light-emitting units 10B/10C. In addition, the light-emitting end 201C of the terminal switch 220 is coupled with a terminal end 100C of the light-emitting units 10A~10C and the reference voltage of the terminal switch 220 is larger than the reference voltage of any one of the operating switches 210A/210B. Particularly, the voltage generating module 50 is coupled with the switches and provides the reference voltage of each corresponding switch, wherein the reference voltage of each switch is different. In general, the reference voltage of the operating switch 210B is preferably larger than the reference voltage of the operating switch 210A. In the embodiment, the reference voltages of the operating switch 210A, the operating switch 210B, and the terminal switch 220 are respectively 5V, 10V, and 15V, and the critical activation voltage of each switch is 1.5V, but is not limited to the embodiment.

In practical applications, the bias current module 30 is coupled with the bias ends 202A/202B/202C of the switches and has an operating bias voltage which varies according to the frequency, wherein each switch is driven to be activated or to be deactivated according to a relation of the critical activation voltage and a difference between the reference voltage and the operating bias voltage. In particular, the frequency of the operating bias voltage is preferably the same as the frequency of the input voltage, so that the voltage driving the light-emitting unit 10A~10C is synchronized with the operating bias voltage to avoid wasting power. In practical conditions, the bias current module 30 can be a transistor or a voltage-to-current circuit and generate a plurality of operating bias voltages of the saturation region. In the embodiment, the minimum of the operating bias voltage of the saturation region is 1V, and the operating bias voltage of the saturation region includes 4.8V and 9.8V, but is not limited to the embodiment.

Figure 3:
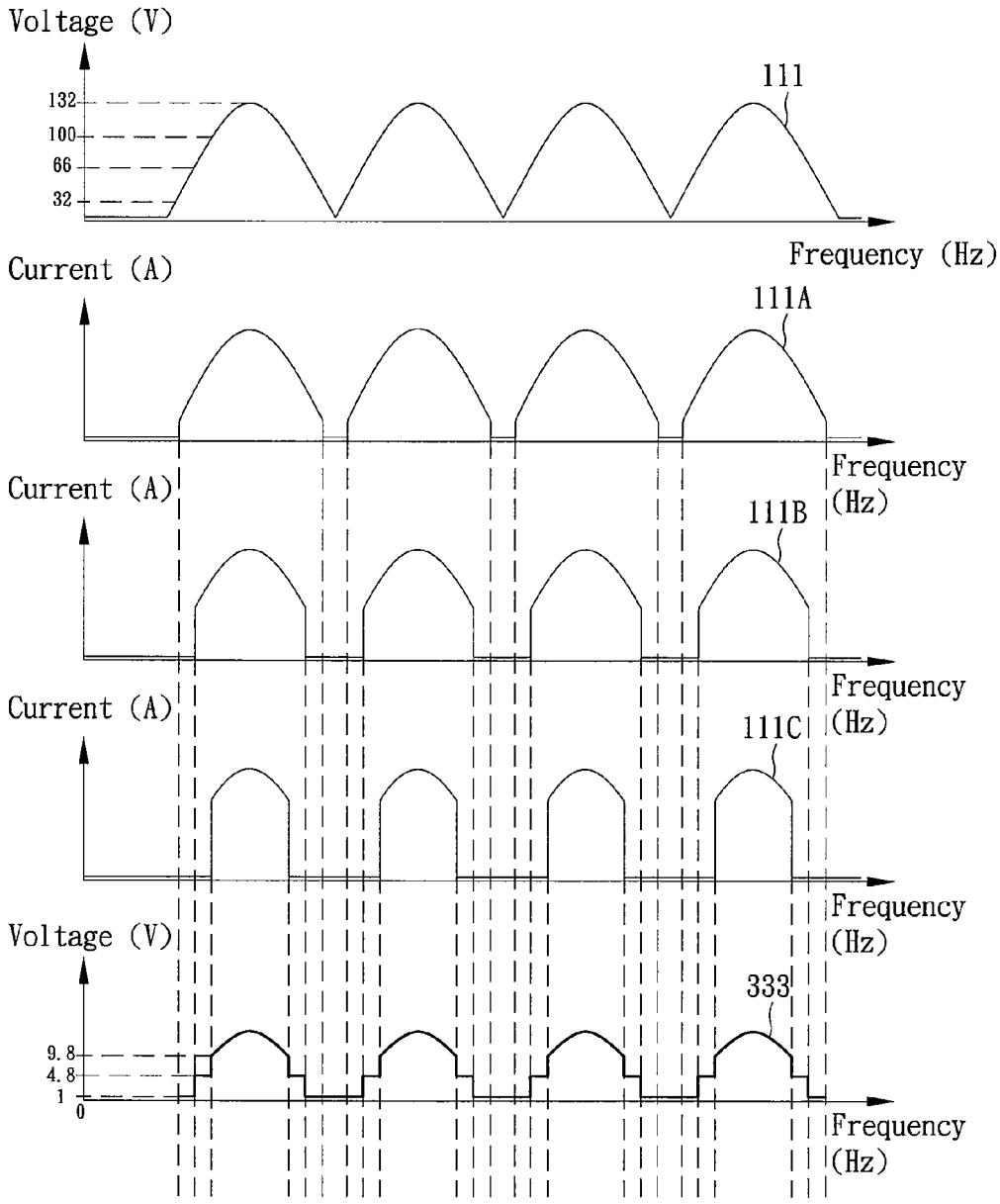
FIG. 3 is a schematic view of voltage-frequency curves of the present invention.

Furthermore, a corresponding one of the switches is driven to be activated when the reference voltage thereof is larger than the operating bias voltage and the difference between the reference voltage thereof and the operating bias voltage is equal to or larger than the critical activation voltage thereof. For instance, each light-emitting unit has 10 LED devices (not shown), and the voltage for driving one LED device to generate light is 3 V, so that the driving voltage of each light-emitting unit is 30 V, but the driving voltage is not limited to the embodiment. Please refer to FIG. 3; FIG. 3 is a schematic view showing voltage-frequency curves of the present invention. As shown in FIG. 3, 111 indicates an input voltage curve; 111A indicates a current curve of the light-emitting unit 10A; 111B indicates a current curve of the light-emitting unit 10B; 111C indicates a current curve of the light-emitting unit 10C; 333 indicates an operating bias voltage. For instance, when the input voltage is 32 V and the operating bias voltage of the bias current module 30 is 1 V, the input voltage drives the light-emitting unit 10A to generate light and the remaining of the input voltage (2 V) drives the operating switch 210A to be activated. In addition, the difference between the reference voltage (5 V) of the operating switch 210A and the operating bias voltage is 4 V, which is larger than or equal to the critical activation voltage (1.5 V), so that the operating switch 210A is at activating stage. It is noted that the current does not flow through the light-emitting units 10B/10C due to a lack of the crossing voltage thereof, so that the operating switch 210B and the terminal switch 220 cannot be driven to be activated. In the meantime, the light-emitting unit 10A and the operating switch 210A are at activating stage. In addition, in other embodiments (not shown), the bias current module 30 can be a current module utilizing high voltage (over 50 V), so the driving circuit 1 can utilize the operating switch 210A/210B to enhance the light-emitting efficiency without utilizing the terminal switch 220, but not limited to the embodiment.

As shown in FIG. 3, the input voltage continues increasing from 32V. For instance, when the input voltage is 66V and the operating bias voltage of the bias current module 30 is 4.8V, the input voltage drives the light-emitting unit 10A and the light-emitting unit 10B to generate light and the remaining of the input voltage (6V) drives the operating switch 210B to be activated. It is noted that the difference between the operating bias voltage and the reference voltage (10V) of the operating switch 210B is 5.2V, which is larger than or equal to the critical activation voltage (1.5V), so that the operating switch 210B is at activating stage. In addition, the difference between the operating bias voltage (4.8V) and the reference voltage (5V) of the operating switch 210A is 0.2V, which is less than the critical activation voltage (1.5V), so that the operating switch 210A is at deactivating stage. It is noted that the current does not flow through the light-emitting unit 10C due to a lack of the crossing voltage thereof, so that the terminal switch 220 cannot be driven to be activated. In the meantime, the light-emitting unit 10A, the light-emitting unit 10B, and the operating switch 210B are at activating stage. In other words, the driving circuit 1 only utilizes one switch to drive one or more light-emitting units to generate light, further decreasing the waste of power and resolving the heat-dissipating issue.

Please refer to FIG. 3; the input voltage continues increasing from 66V. For instance, when the input voltage is 100V and the operating bias voltage of the bias current module 30 is 9.8V, the input voltage drives the light-emitting unit 10A, the light-emitting unit 10B, and the light-emitting unit 10C to generate light and the remaining of the input voltage (10V) drives the terminal switch 220 to be activated. It is noted that the difference between the operating bias voltage and the reference voltage (15V) of the terminal switch 220 is 5.2V, which is larger than or equal to the critical activation voltage (1.5V), so that the terminal switch 220 is at activating stage. In addition, the reference voltage (5V) of the operating switch 210A is less than the operating voltage (9.8V), so that the operating switch 210A is at deactivating stage, and the difference between the operating bias voltage (9.8V) and the reference voltage (10V) of the operating switch 210B is 0.2V, which is less than the critical activation voltage (1.5V), so that the operating switch 210B is at deactivating stage. In the meantime, the light-emitting unit 10A, the light-emitting unit 10B, the light-emitting unit 10C, and the terminal switch 220 are at activating stage. In other words, the driving circuit 1 only utilizes one switch to drive one or more light-emitting units to generate light, further increasing the operating efficiency.

Furthermore, the input voltage continues increasing from 100V, and the operating bias voltage of the bias current module 30 is 13.5V, so that the input voltage drives the light-emitting unit 10A, the light-emitting unit 10B, and the light-emitting unit 10C to generate light, and the remaining of the input voltage (42V) drives the terminal switch 220 to be activated. It is noted that the difference between the operating bias voltage (13.5V) and the reference voltage (15V) of the terminal switch 220 is 1.5V, which is larger than or equal to the critical activation voltage (1.5V), so that the terminal switch 220 is at activating stage. In addition, the reference voltage (5V) of the operating switch 210A and the reference voltage (10V) of the operating switch 210B are respectively less than the operating voltage (13.5V), so that the operating switch 210A and the operating switch 210B are at deactivating stage, and the light-emitting unit 10A, the light-emitting unit 10B, the light-emitting unit 10C, and the terminal switch 220 are at activating stage.

The voltage curve begins decreasing from the peak (132V). For instance, when the input voltage is 100V and the operating bias voltage of the bias current module 30 is 9.8V, the input voltage drives the light-emitting unit 10A, the light-emitting unit 10B, and the light-emitting unit 10C to generate light and the remaining of the input voltage (10V) drives the terminal switch 220 to be activated. It is noted that the difference between the operating bias voltage and the reference voltage (15V) of the terminal switch 220 is 5.2V, which is larger than or equal to the critical activation voltage (1.5V), so that the terminal switch 220 is at activating stage. In addition, the reference voltage (5V) of the operating switch 210A is less than the operating voltage (9.8V), so that the operating switch 210A is at deactivating stage; and the difference between the operating bias voltage (9.8V) and the reference voltage (10V) of the operating switch 210B is 0.2V, which is less than the critical activation voltage (1.5V), so that the operating switch 210B is at deactivating stage. In the meantime, the light-emitting unit 10A, the light-emitting unit 10B, the light-emitting unit 10C, and the terminal switch 220 are at activating stage. In other words, the driving circuit 1 only utilizes one switch to drive one or more light-emitting units to generate light, further increasing the operating efficiency.

As shown in FIG. 3, the voltage curve continues decreasing from 100V. For instance, the input voltage drives the light-emitting unit 10A and the light-emitting unit 10B to generate light and the remaining of the input voltage (6V) drives the operating switch 210B to be activated when the input voltage is 66V and the operating bias voltage of the bias current module 30 is 4.8V. It is noted that the difference between the operating bias voltage and the reference voltage (10V) of the operating switch 210B is 5.2V, which is larger than or equal to the critical activation voltage (1.5V), so that the operating switch 210B is at activating stage. In addition, the difference between the operating bias voltage (4.8V) and the reference voltage (5V) of the operating switch 210A is 0.2V, which is less than the critical activation voltage (1.5V), so that the operating switch 210A is at deactivating stage. It is noted that the current does not flow through the light-emitting unit 10C due to a lack of the crossing voltage thereof, so that the terminal switch 220 cannot be driven to be activated. In other words, the driving circuit 1 only utilizes one switch to drive one or more light-emitting units to generate light, further decreasing the waste of power and resolving the heat-dissipating issue.

The voltage curve continues decreasing from 66V. For instance, the input voltage drives the light-emitting unit 10A to generate light and the remaining of the input voltage (2V) drives the operating switch 210A to be activated when the input voltage is 32V and the operating bias voltage of the bias current module 30 is 1V. In addition, the difference between the operating bias voltage and the reference voltage (5V) of the operating switch 210A is 4V, which is larger than or equal to the critical activation voltage (1.5V), so that the operating switch 210A is at activating stage. It is noted that the current does not flow through the light-emitting units 10B/10C due to a lack of the crossing voltage thereof, so that the operating switch 210B and the terminal switch 220 cannot be driven to be activated. In the meantime, the light-emitting unit 10A and the operating switch 210A are at the activation stage.

In addition, the present invention provides embodiments of FIGS. 2 and 3 to explain the relation between the current and the voltage of some components of the driving circuit. Please refer to FIG. 2; the power supply rectifier 40 is coupled with the bias current module 30 and the voltage generating module 50. In practical applications, the power supply rectifier 40 respectively transmits the input voltage into the bias current module 30 and the voltage generating module 50. In the embodiment, the bias current module 30 has an amplifier, a resistor, and a voltage generating unit (not shown), wherein the amplifier, the resistor, and the voltage generating unit form a negative feedback circuit. Furthermore, the power supply rectifier 40 transmits the input voltage into the voltage generating unit of the bias current module 30, and the voltage generating unit converts the input voltage to generate a partial voltage to the amplifier, wherein the partial voltage is the full-wave rectification voltage.

Figure 4:
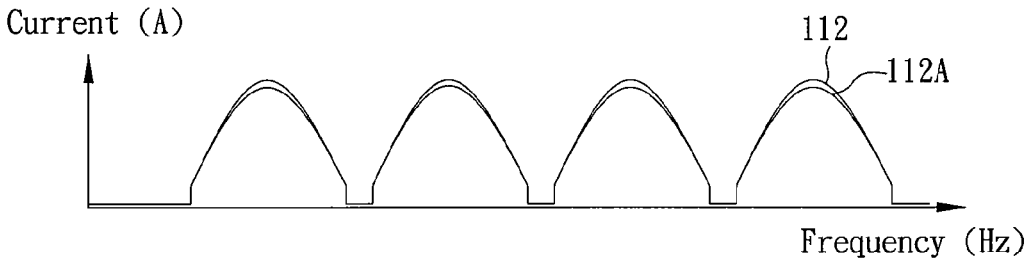
FIG. 4 is a schematic view showing the relation between the input current curve and the current of the light-emitting unit of the present invention.

In addition, the driving circuit 1 controls a bias current of the bias current module 30 according to the partial voltage and the resistor, wherein the bias current is the current flowing through the light-emitting units. In other words, the current waveforms of the light-emitting units 10A~10C are similar to the current waveform of the input voltage. Please refer to FIG. 4; FIG. 4 is a schematic view showing the relation between the input current curve and the current of the light-emitting unit 10A. As shown in FIG. 4, 112 indicates an input current curve, and 112A indicates a current curve of the light-emitting unit 10A. It is noted that the input current curve 112 and the current curve of the light-emitting unit 10A have the same frequency and similar full-wave rectification waveform. In other words, less input current is wasted when the input voltage drives the light-emitting units to generate light, further increasing efficiency. In addition, as shown in FIGS. 3 and 4, the current curves of the light-emitting unit and the input voltage have similar full-wave rectification waveform to decrease the waste of power, further increasing power factor. In practical applications, the power factor of the driving circuit 1 can reach 0.9988, and the driving circuit 1 has high power factor.

Hence, the driving circuit 1 can utilize the bias current module to control the current of the light-emitting units and drives the switches to be activated or to be deactivated without utilizing any comparator for providing the required voltage of the switches, further decreasing the waste of power and increasing light-emitting efficiency.

In addition, the present invention provides driving circuits, which facilitate heat dissipation, in the following three modified embodiments.

Figure 5:
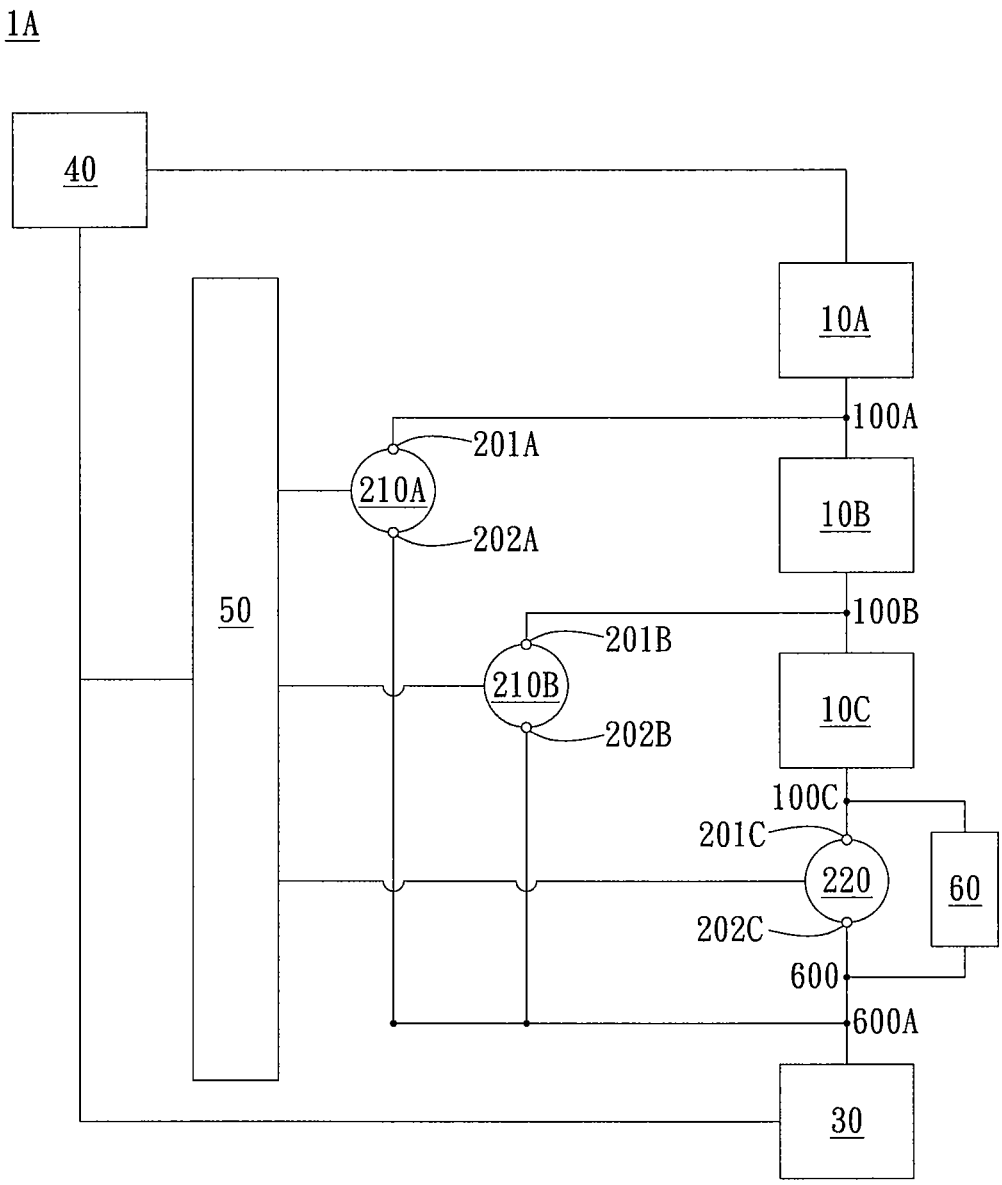
FIG. 5 is a schematic view of the embodiment of the driving circuit of the present invention.

Please refer to FIG. 5; FIG. 5 is a schematic view of the embodiment of the driving circuit of the present invention. As shown in FIG. 5, compared to the driving circuit 1 of FIG. 2, the driving circuit 1A further has at least one heat sink module 60. It is noted that the heat sink module 60 is coupled with at least one of the switches, wherein the input voltage generates a current; the current flows through the heat sink module 60, so that the heat sink module 60 generates power. In the embodiment, the heat sink module 60 is coupled with at least one of the switches in parallel. Particularly, the heat sink module 60 is coupled with the end 100C and the node 600, wherein the node 600 is disposed between the bias end 202C of the terminal switch 220 and a node 600A, and the node 600A is a coupling node coupled with the bias end 202A/202B/202C of the switches thereof. In practical applications, the heat sink module 60 can be resistors, transistors, or other electronic components capable of generating power. In the embodiment, the heat sink module 60 is the resistors and can decrease current magnitude of the terminal switch 220, further enhancing the efficiency of heat dissipation.

Figure 6:
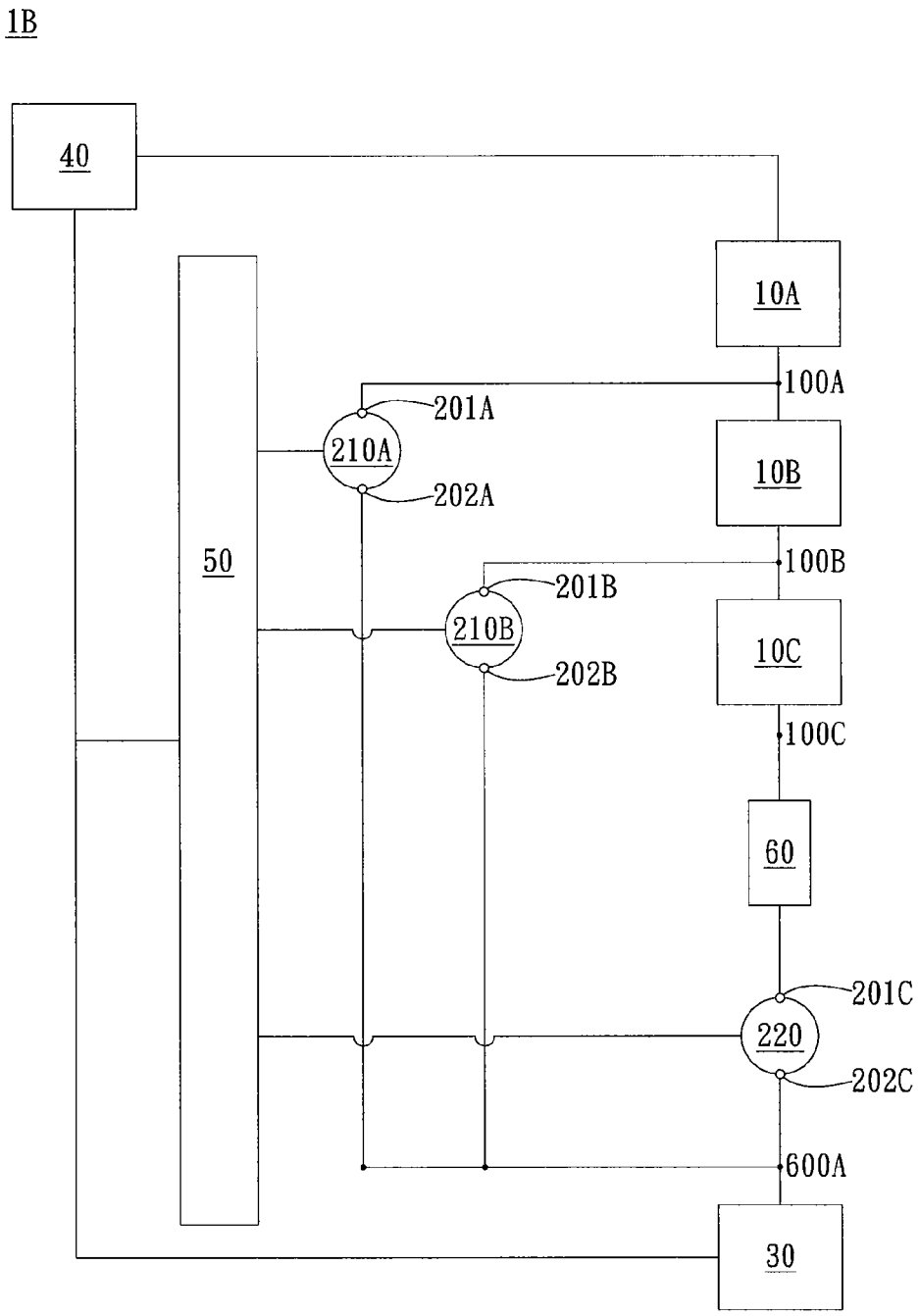
FIG. 6 is a schematic view of an embodiment of the driving circuit of the present invention.

Please refer to FIG. 6; FIG. 6 is a schematic view of an embodiment of the driving circuit of the present invention. As shown in FIG. 6, the heat sink module 60 of the driving circuit 1B is coupled with at least one of the switches in series. Furthermore, the heat sink module 60 is coupled with the terminal switch 220 in series. Particularly, two ends of the heat sink module 60 are respectively coupled with the end 100C and the light-emitting end 201C of the terminal switch 220. In other words, the heat sink module of the driving circuit 1B is coupled between the end 100C and the light-emitting end 201C of the terminal switch 220. In practical applications, the heat sink module 60 shares the voltage of the terminal switch 220 and generates power, so that the efficiency of heat dissipation is improved.

Figure 7:
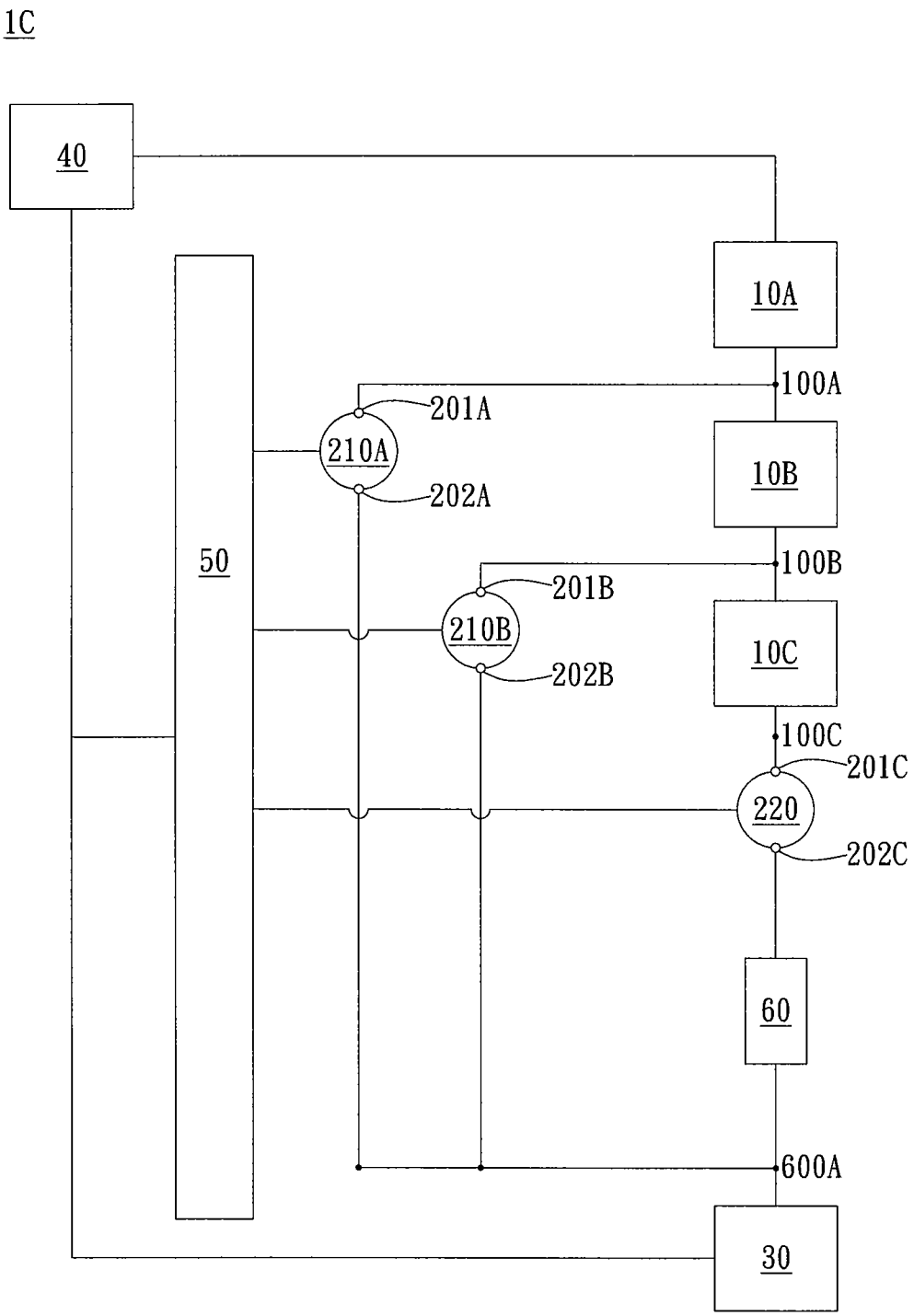
FIG. 7 is a schematic view of an embodiment of the driving circuit of the present invention.

Please refer to FIG. 7; FIG. 7 is a schematic view of an embodiment of the driving circuit of the present invention. As shown in FIG. 7, the heat sink module 60 of the driving circuit 1C is coupled between the bias end 202C of the terminal switch 220 and the node 600A. It is noted that, compared to the driving circuit 1A/1B, the voltage of the bias current module 30 is shared by the heat sink module 60 of the driving circuit 1C, and the heat sink module 60 generates power to facilitate dissipating heat from the bias current module 30.

Figure 8:
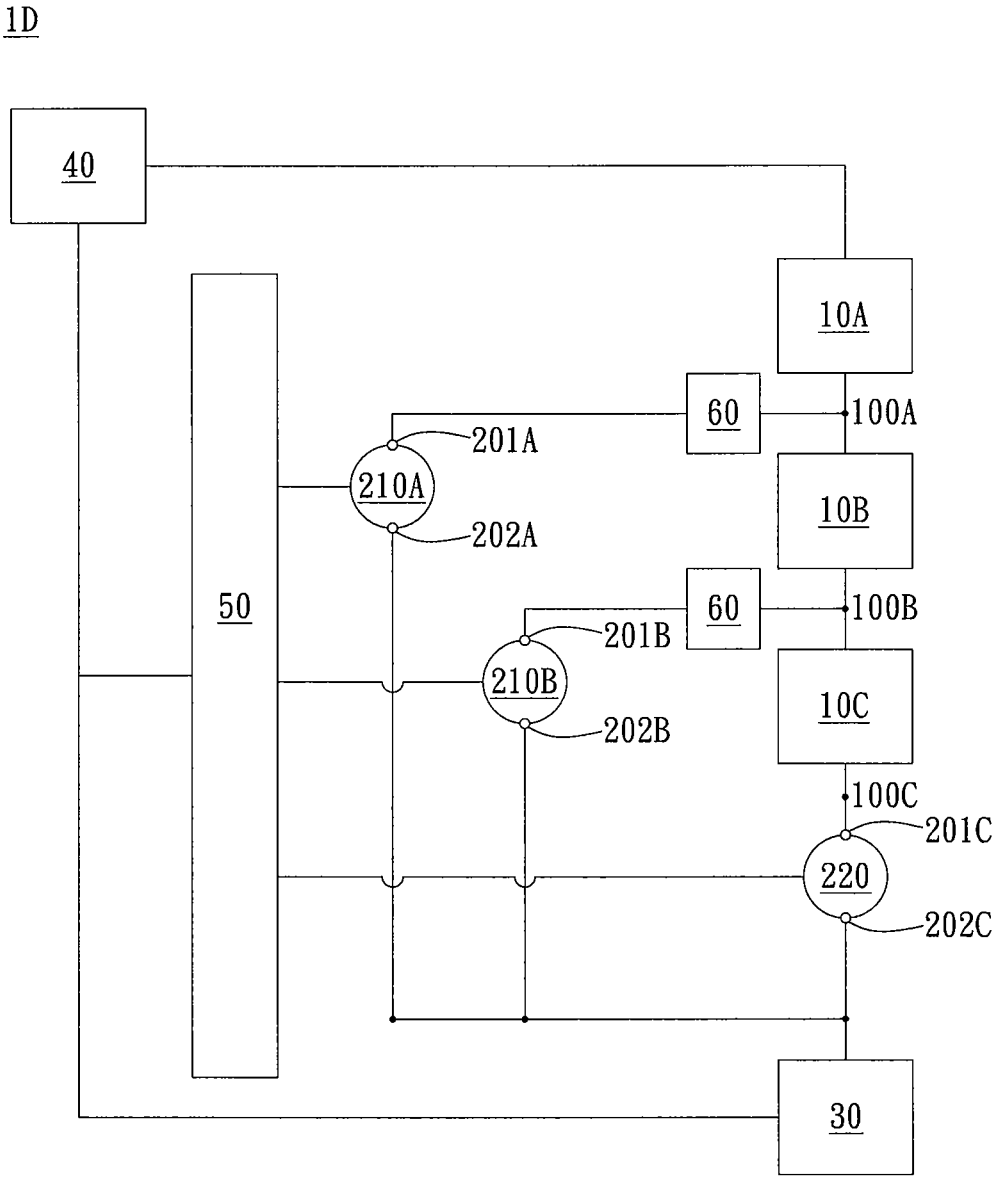
FIG. 8 is a schematic view of an embodiment of the driving circuit of the present invention.

Please refer to FIG. 8; FIG. 8 is a schematic view of an embodiment of the driving circuit of the present invention. As shown in FIG. 8, the heat sink modules 60 of the driving circuit 1D are respectively coupled between the operating switches 210A/210B and the coupling nodes 100A/100B. In practical applications, the heat sink module 60 can be coupled with the operating switches 210A/210B and the coupling nodes 100A/100B or can be coupled between one operating switch and the coupling node corresponding to the operating switch. The disposition of the heat sink module 60 is not limited to the embodiment. In the embodiment, the heat sink modules 60 are respectively coupled between the operating switches 210A/210B and the coupling nodes 100A/100B. It is note that, compared to the driving circuit 1A-1C, the voltage of the operating switches is shared by the heat sink module 60 of the driving module 1D, and the heat sink module 60 can generate power to facilitate dissipating heat from the operating switch thereof. In other words, the driving circuit 1A~1D utilize the heat sink module 60 to share operating power of the operating switches or the bias current module 30. In other words, the driving circuit 1A~1D can utilize the light-emitting units having large power (such as 20 W) to increase operating efficiency and facilitate dissipating heat.

Compared to prior arts, the driving circuit of the present invention utilizes the switches having the reference voltage and the critical activation voltage and also changes the connecting relation between the switches and the light-emitting units, further simplifying the configuration of the driving circuit. In practical applications, no matter how many light-emitting units are driven to be activated, any one of the switches needs to be activated without driving all of the switches to be activated. In addition, the voltage and the input voltage utilized by the light-emitting units are full-wave rectification voltages, so that less input voltage is wasted, enhancing the efficiency.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

The invention claimed is:

1. A driving circuit, comprising:

a plurality of light-emitting units, wherein the light-emitting units are coupled with each other in series and are driven with an input voltage varying according to a frequency;

a plurality of switches, wherein each switch has a reference voltage and a critical activation voltage and comprises a light-emitting end and a bias end opposite to the light-emitting end, the light-emitting end is coupled with the light-emitting units, and the bias ends of the switches are coupled with each other; and a bias current module coupled with the bias ends of the switches and having an operating bias voltage varying according to the frequency, wherein each switch is driven to be activated or to be deactivated according to a relation of the critical activation voltage and a difference between the reference voltage and the operating bias voltage.

2. The driving circuit of claim 1, wherein the switches comprises:

a plurality of operating switches, wherein the light-emitting ends of the operating switches are respectively coupled with a plurality of coupling nodes of the light-emitting units; and a terminal switch, wherein the light-emitting end of the terminal switch is coupled with a terminal end of the light-emitting units, and the reference voltage of the terminal switch is larger than the reference voltage of any one of the operating switches.

3. The driving circuit of claim 1, wherein a corresponding one of the switches is driven to be activated when the reference voltage thereof is larger than the operating bias voltage and the difference between the reference voltage thereof and the operating bias voltage is equal to or larger than the critical activation voltage thereof.

4. The driving circuit of claim 1, further comprising:

a power supply rectifier coupled with the light-emitting units and providing the input voltage, wherein the input voltage is a full-wave rectification voltage.

5. The driving circuit of claim 4, wherein a voltage crossing over the light-emitting units is a full-wave rectification voltage.

6. The driving circuit of claim 1, further comprising:

a voltage generating module coupled with the switches and providing the reference voltage of each corresponding switch.

7. The driving circuit of claim 1, wherein the reference voltage of each switch is different.

8. The driving circuit of claim 2, further comprising:

at least one heat sink module coupled with at least one of the switches, wherein the input voltage generates a current, the current flows through the at least one heat sink module, so that the at least one heat sink module generates power.

9. The driving circuit of claim 8, wherein the at least one heat sink module is coupled with at least one of the switches in parallel.

10. The driving circuit of claim 8, wherein the at least one heat sink module is coupled with at least one of the switches in series.

* * * * *